US008333599B2

(12) United States Patent
Xu et al.

(10) Patent No.: US 8,333,599 B2
(45) Date of Patent: Dec. 18, 2012

(54) MODULAR JACK HAVING AN IMPROVED MAGNETIC MODULE

(75) Inventors: Yong-Chun Xu, Kunshan (CN); Jie Zhang, Kunshan (CN); Chao-Tung Huang, Tu-Cheng (TW); Xiao-Hua Liu, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 913 days.

(21) Appl. No.: 12/383,516

(22) Filed: Mar. 25, 2009

(65) Prior Publication Data

US 2009/0243757 A1 Oct. 1, 2009

(30) Foreign Application Priority Data

Mar. 25, 2008 (CN) ..... 2008 2 0033107 U

(51) Int. Cl.
*H01R 12/00* (2006.01)

(52) U.S. Cl. ..... 439/76.1; 439/676

(58) Field of Classification Search ..... 439/76.1, 439/541, 5, 620.05–620.07, 620.11–620.13, 439/620.15–620.17, 620.21, 620.23, 941, 439/676; 333/118, 119, 124, 131, 177
See application file for complete search history.

(56) References Cited

U.S. PATENT DOCUMENTS

| | | | | |
|---|---|---|---|---|
| 5,015,204 | A | 5/1991 | Sakamoto et al. | |
| 5,069,641 | A | 12/1991 | Sakamoto et al. | |
| 5,139,442 | A | 8/1992 | Sakamoto et al. | |
| 5,736,910 | A * | 4/1998 | Townsend et al. | 333/181 |
| 6,114,924 | A * | 9/2000 | Cain et al. | 333/112 |
| 6,542,047 | B2 * | 4/2003 | Chen et al. | 333/119 |
| 6,806,790 | B2 * | 10/2004 | Ji | 333/119 |
| 6,963,255 | B2 * | 11/2005 | Zheng et al. | 333/131 |

* cited by examiner

*Primary Examiner* — Thanh Tam Le
(74) *Attorney, Agent, or Firm* — Wei Te Chung; Ming Chieh Chang

(57) ABSTRACT

A modular jack (3) has an insulative housing (6), a printed circuit board (92), a number of cores (931-934) and a magnetic core (935), a number of conductive wires (936-939) respectively wind around the cores and then around the magnetic core together, and a number of grounding wires. The grounding wires has a first grounding wire having one end connected to the conductive wire and another end winding around the magnetic core for grounding, and other grounding wires respectively having one end load connected to the corresponding conductive wire and opposite end load directly connected to the first grounding wire.

6 Claims, 8 Drawing Sheets

3

MODULAR JACK HAVING AN IMPROVED MAGNETIC MODULE

BACKGROUND OF THE INVENTION

1. Field of the Invention

The present invention relates to a modular jack, and more particularly to a modular jack having improved magnetic module efficiently eliminating electromagnetic interference to signal.

2. Description of Prior Arts

U.S. Pat. No. 5,736,910 issued to Townsend et al on Apr. 7, 1998 discloses a modular jack mounted onto a mother printed circuit board and adapted for receiving a plug. The modular jack includes a housing defining a receptacle, a daughter printed circuit board attached to a rear portion of the housing, a first set of contacts mounted to the housing for engaging with the plug and a second set of contacts assembled to the printed circuit board for connecting to the mother printed circuit board. A plurality of groups of toroidal coil pairs are interposed between the first contacts and the second contacts for eliminating high frequency noise. Each toroidal coil pair has a first toroidal core performing as a common mode filter, a second toroidal core performing as a transformer. Each toroidal coil pair has at least a coil wound around the first toroidal core and the second toroidal core for electrically connecting the first core and the second toroidal cores together.

U.S. Pat. No. 5,069,641 issued to Sakamoto et al. discloses a modular jack to be mounted on an outer circuit board. The modular jack has a printed circuit board having a noise suppressing electronic element received in a housing. The printed circuit board is fitted with contacts for contacting with plugs and terminals to mount the modular jack on the outer circuit board. The contacts and the terminals are electrically connected with the noise suppressing electronic element by wires on the printed circuit board.

In general, it needs more space for locating such a large number of the toroidal coil pairs between the first and the second set of contacts, which increase the cost of manufacture.

Hence, it is desirable to provide an improved modular jack to overcome the aforementioned disadvantages.

SUMMARY OF THE INVENTION

An object of the present invention is to provide a modular jack having a magnetic module which occupying less space on a daughter board.

To achieve the above object, a modular jack comprises an insulative housing defining a receiving space, a printed circuit board disposed within the receiving space, a plurality of cores and a magnetic core disposed on the printed circuit boards, a plurality of conductive wires respectively wind around the cores and then around the magnetic core together, and a plurality of grounding wires. The grounding wires comprise a first grounding wire having one end connected to the conductive wire and another end winding around the magnetic core, and then to the grounding circuit, and other grounding wires respectively having one end load connected to the corresponding conductive wire and opposite end load directly connected to the first grounding wire.

Advantages of the present invention are to provide a first core connecting with a magnetic core by a wire to form a first circuit for eliminating high frequency noise of the first terminals and the second terminals, a second core connecting with the magnetic core by a wire to form a second circuit for eliminating high frequency noise of the first terminals and the second terminals. Therefore, it is efficient to electrically connect the first terminals and the second terminals by a group of toroidal coil unit and reduce the cost of manufacture.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
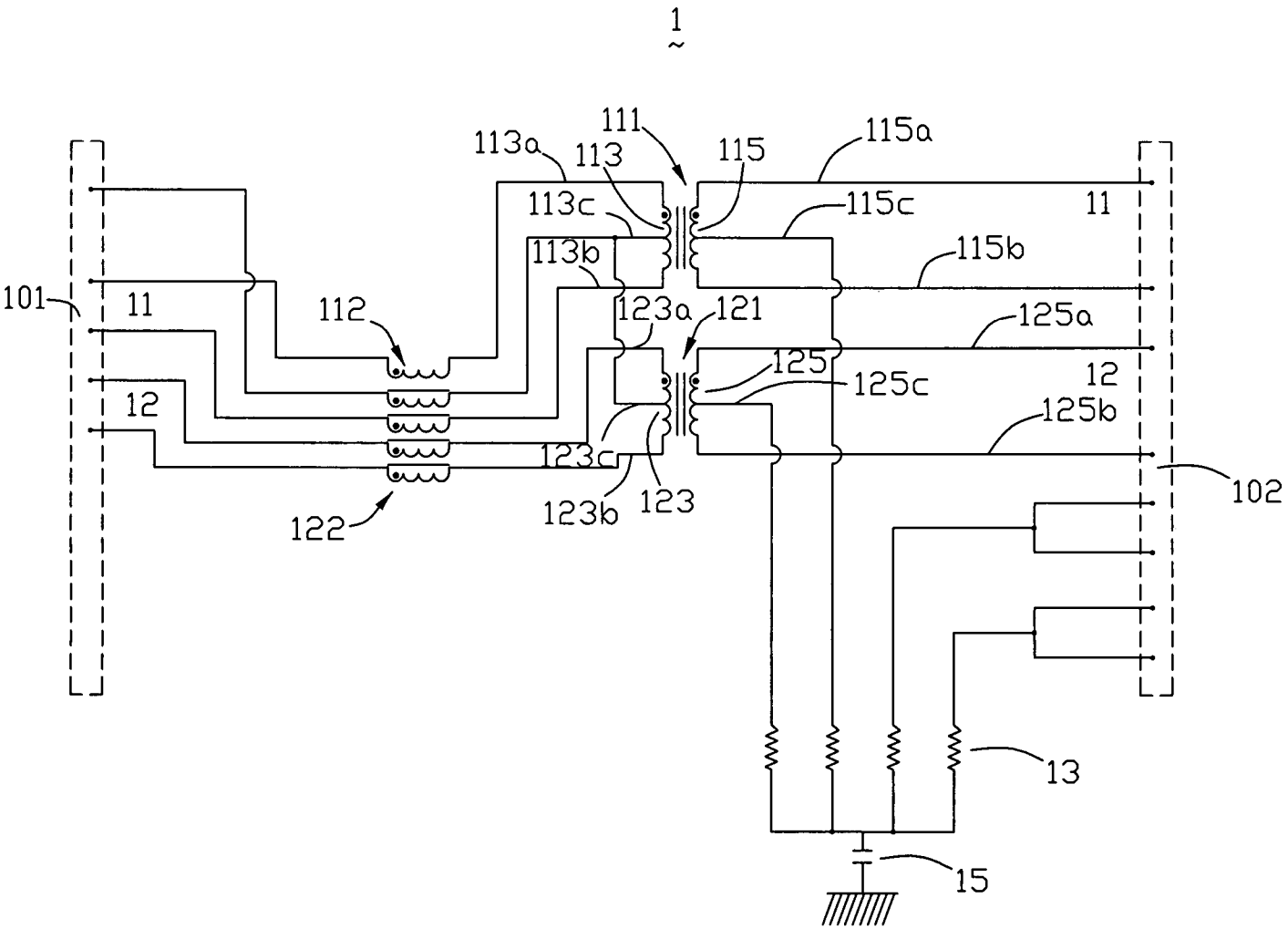
FIG. 1 is a magnetic interference circuit diagram for a communication port in accordance with a first embodiment of the present invention.

Reference will now be made to the drawing figures to describe the present invention in detail. Referring to FIG. 1, a magnetic interference circuit for a communication port 1 used in 10/100 Base-T network appliance comprises a first transmission line 11 and a second transmission line 12.

The first transmission line 11 comprises an input port 101 and an output port 102 for transmitting data or signals along the transmission line 11. The first transmission line 11 comprises a first core (not labeled), a magnetic core (not labeled), a first primary coil 113 and a first secondary coil 115 wound around the first core. The first primary coil 113 has an end 113*a* connected to the input port 101 and a tip 113*b* wound around the magnetic core and then terminated to the input port 101. The first primary coil 113 winds around the first core to form a first transformer 111. The first primary coil 113 winds around the magnetic core to function as a first common mode choke 112. The first secondary coil 115 has a second end 115*a* terminated to the output port 102 and a second tip 115*b* connected to the output port 102. The first transmission line 11 further has a first ground coil 113*c* having opposite ended loads (not labeled) connected to the input port 101 and a first grounding wire 115*c* having opposite ends (not labeled) connected to the output port 102. One ended load of the first ground coil 113*c* is connected to the first primary coil 113, another opposite ended load of the first ground coil 113*c* winds around the magnetic core. Each end of the first grounding wire 115*c* is connected to the first secondary coil 115, and another end of the first grounding wire 115*c* is connected to a resistor 13 and a capacitor 15. When a signal current flows through the first primary-sided transfer-purpose winding, a magnetic field is generated in the first core, and another signal current flows through the first secondary-sided transfer-purpose by an induction current caused by this magnetic field, so that the signal may be transmitted.

The second transmission line 12 is connected to the input port 101 and the output port 102 for transmitting data or signals. The first transmission line 12 comprises a second core (not labeled), the magnetic core (not labeled), a second primary coil 123 and a second secondary coil 125 wound around the first core. The second primary coil 123 has an end 123*a* connected to the input port 101 and a tip 123*b* wound around the magnetic core and then terminated to the input port 101. The second primary coil 123 winds around the second core to form a first transformer 121. The second primary coil 123 winds around the magnetic core to function as a second common mode choke 122. The second secondary coil 125 has a second end 125*a* terminated to the output port 102 and opposite tip 125*b* connected to the output port 102. The second transmission line 12 further has a second ground coil 123*c* having opposite ended loads (not labeled) connected to the input port 101 and a second grounding wire 125*c* having opposite ends (not labeled) connected to the output port 102. One ended load of the second ground coil 123*c* is connected to the second primary coil 123, another opposite ended load of the second ground coil 123*c* is directly connected to the first ground coil 113*c*. Each end of the second grounding wire 125*c* is connected to the second secondary conductive coil 125 and another end of second grounding wire 125*c* is connected to a resistor 13 and the capacitor 15.

Figure 2:
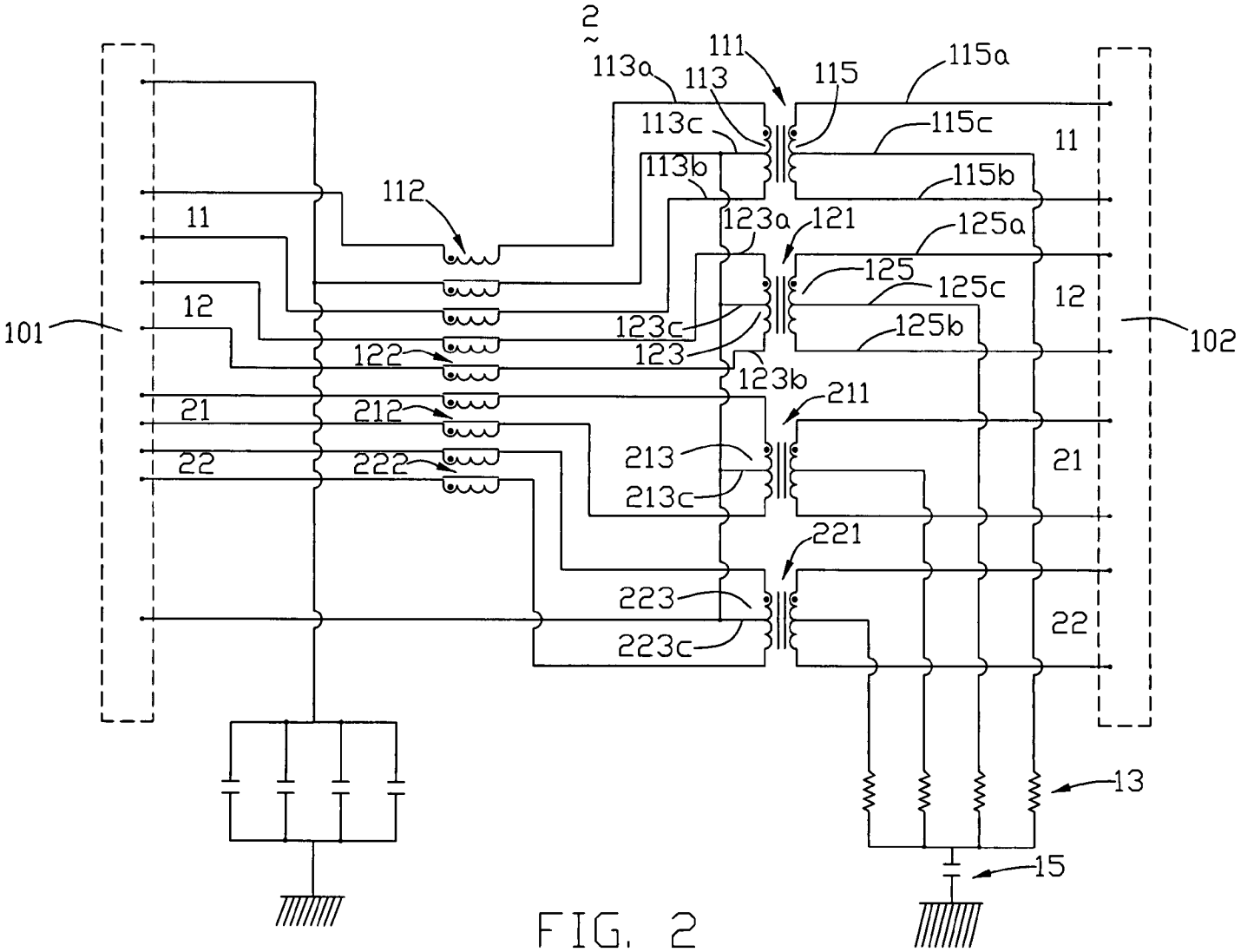
FIG. 2 is a magnetic interference circuit diagram for a communication port of a second embodiment of the present invention.

FIG. 2 illustrates a second preferred embodiment of the present invention. In this embodiment, a communication port 2 used in 10/100 Base-T network appliance comprises a first, a second, a third, and a fourth transmission lines 11, 12, 21 and 22. The first and second transmission lines 11, 12 are also same to that disclosed in the first embodiment. The third and fourth transmission lines 21, 22 respectively have a structure similar to that of the second transmission line 12. One ended load of a third ground coil 213*c* is directly connected to the first ground coil 113*c*. One end of a fourth ground coil 223*c* is also directly connected to the first ground coil 113*c*.

Figure 3:
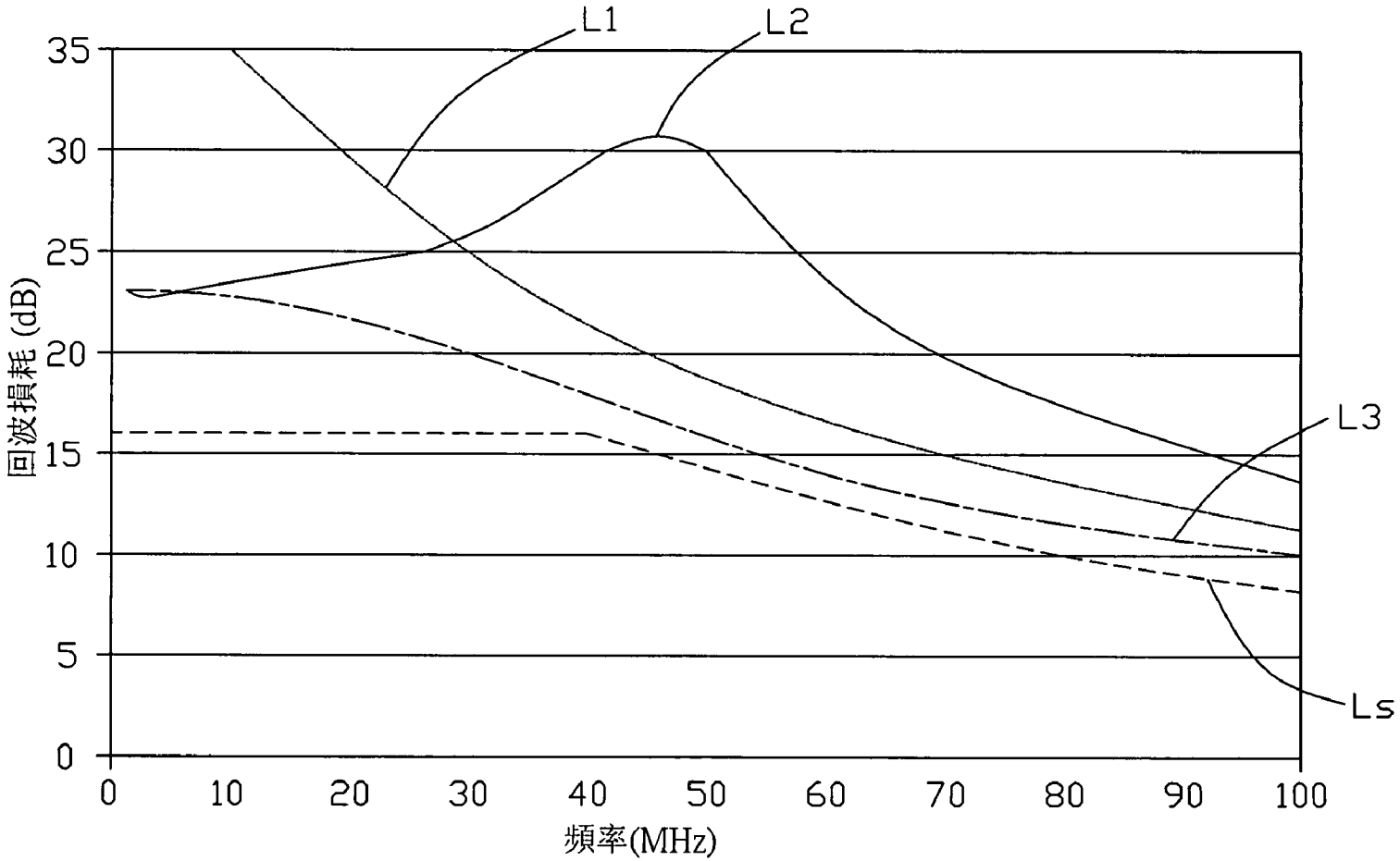
FIG. 3 is a graph illustrating a return loss of the test transmission line of FIG. 2.
Figure 4:
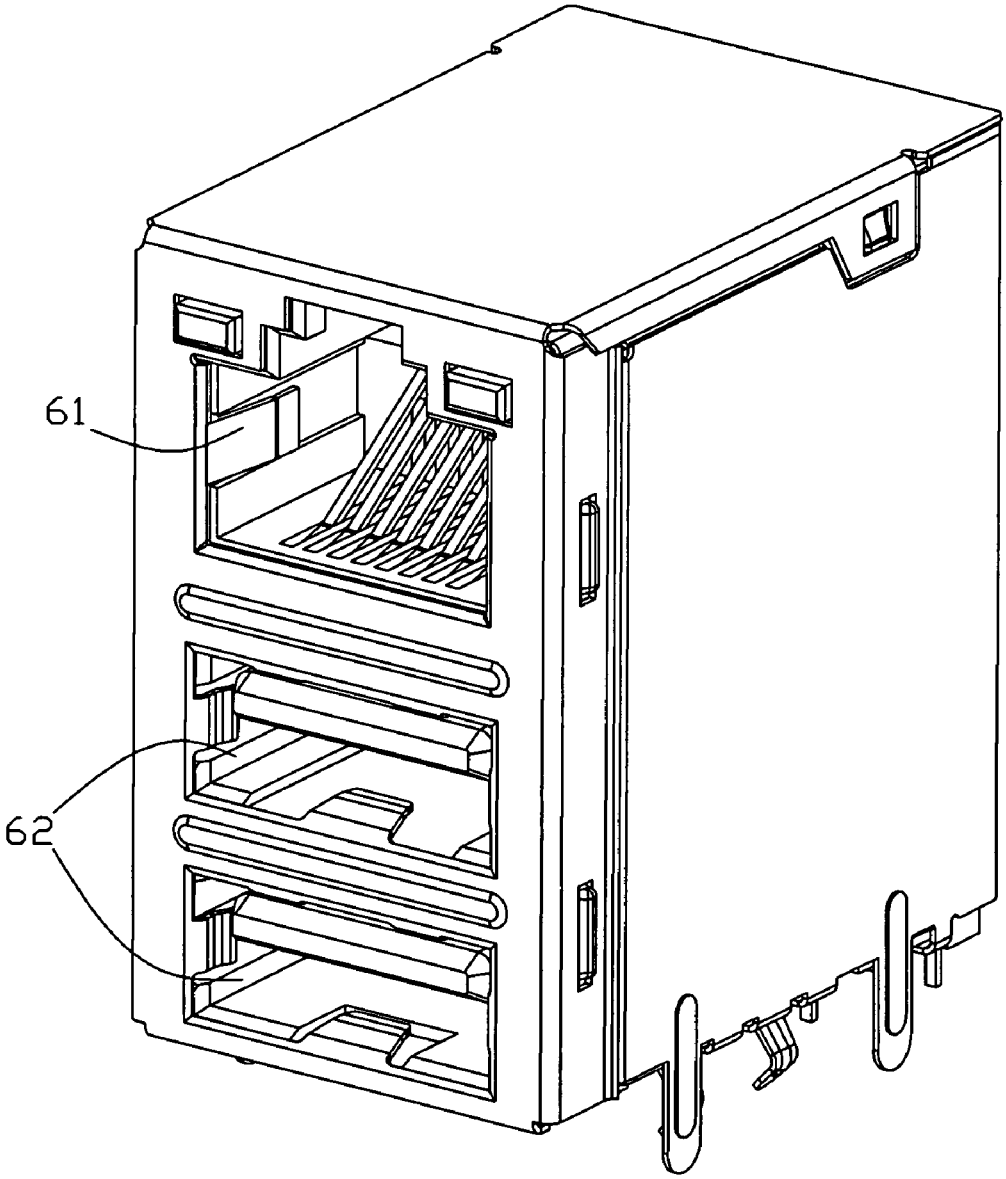
FIG. 4 is an assembled perspective view of a modular jack using the communication port as shown in FIG. 2.

FIG. 3 is a graph illustrating the return losses L1, L2, L3 of the test transmission line 2 as shown in FIG. 2. FIG. 3 shows a structural diagram of a standard return loss in the electrical industry (as shown in LS). The numerical value of the return losses of the transmission line 2 conforms to the standard of the electrical industry.

Reference will now be made to the drawing figures to describe a modular jack 3 having the second transmission line 12 connected to a printed circuit board 92. Referring to FIGS. 4-8, a modular jack 3 is commonly used in the computer or network appliance as input/output port for transmitting data or signals. The modular jack 3 includes a housing 6 defining an opening 61 and a pair of receiving rooms 62 profiled one above another for mating with a modular plug and USB plugs, a magnetic module 9 having the printed circuit board 92, and a shield 4, 5 surrounding the housing 6.

The modular jack 3 has a first set of terminals 91 mounted to a front face of the printed circuit board 92 and received into the opening 61, a second set of terminals 95 mounted at a rear face of the printed circuit board 92 for connecting to a mother board (not shown), and two groups of pins 71 mounted to lower portion of the printed circuit board 92 paralleled to the first set of terminals 91 and extending to the receiving room 62. The modular jack 3 further comprises a pair of LEDs (Light Emitting Diodes) 8 retained in corresponding pipe slots 63 defined on a top portion of the housing 6.

Figure 5:
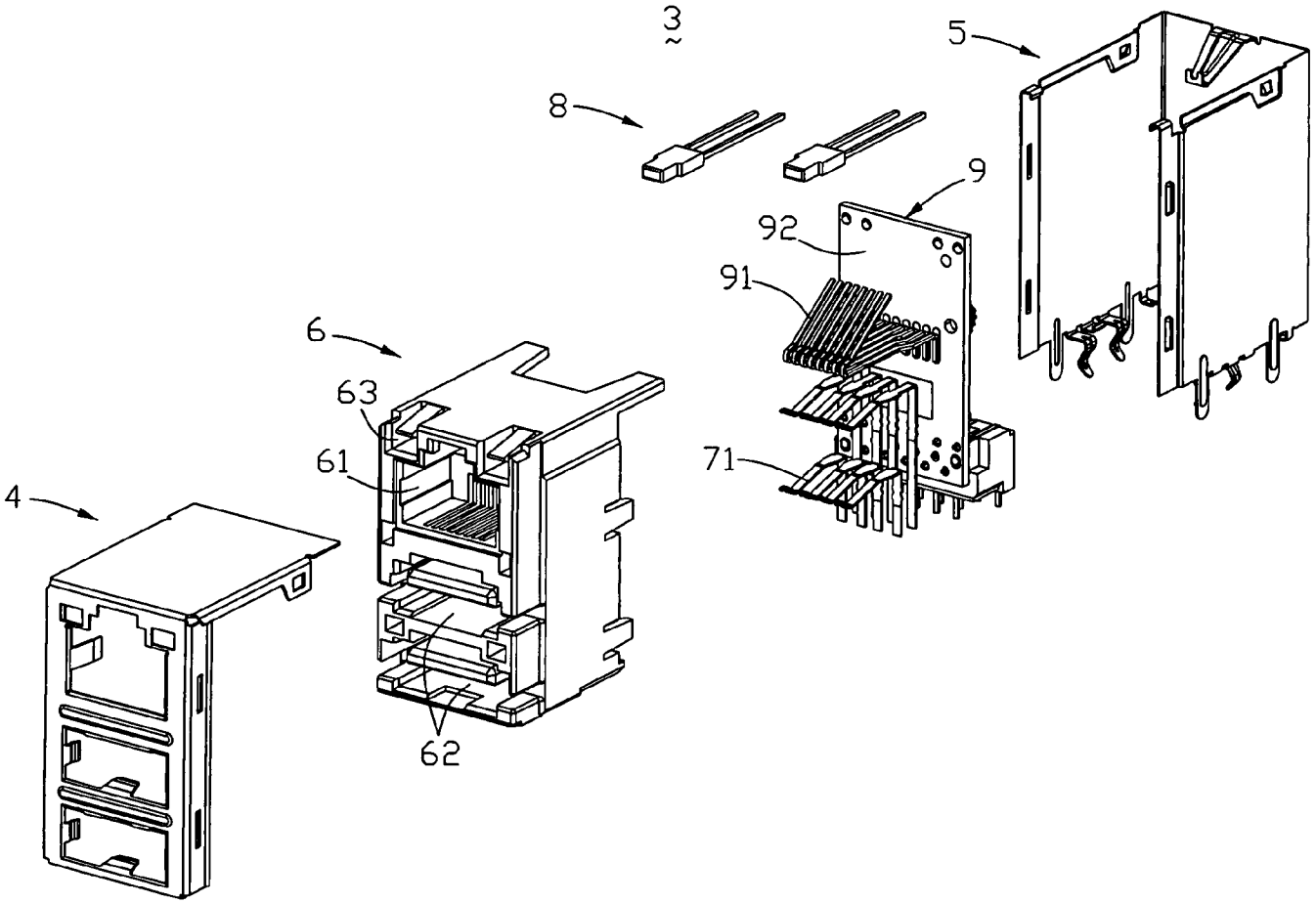
FIG. 5 is an exploded view of the modular jack as shown in FIG. 4.
Figure 6:
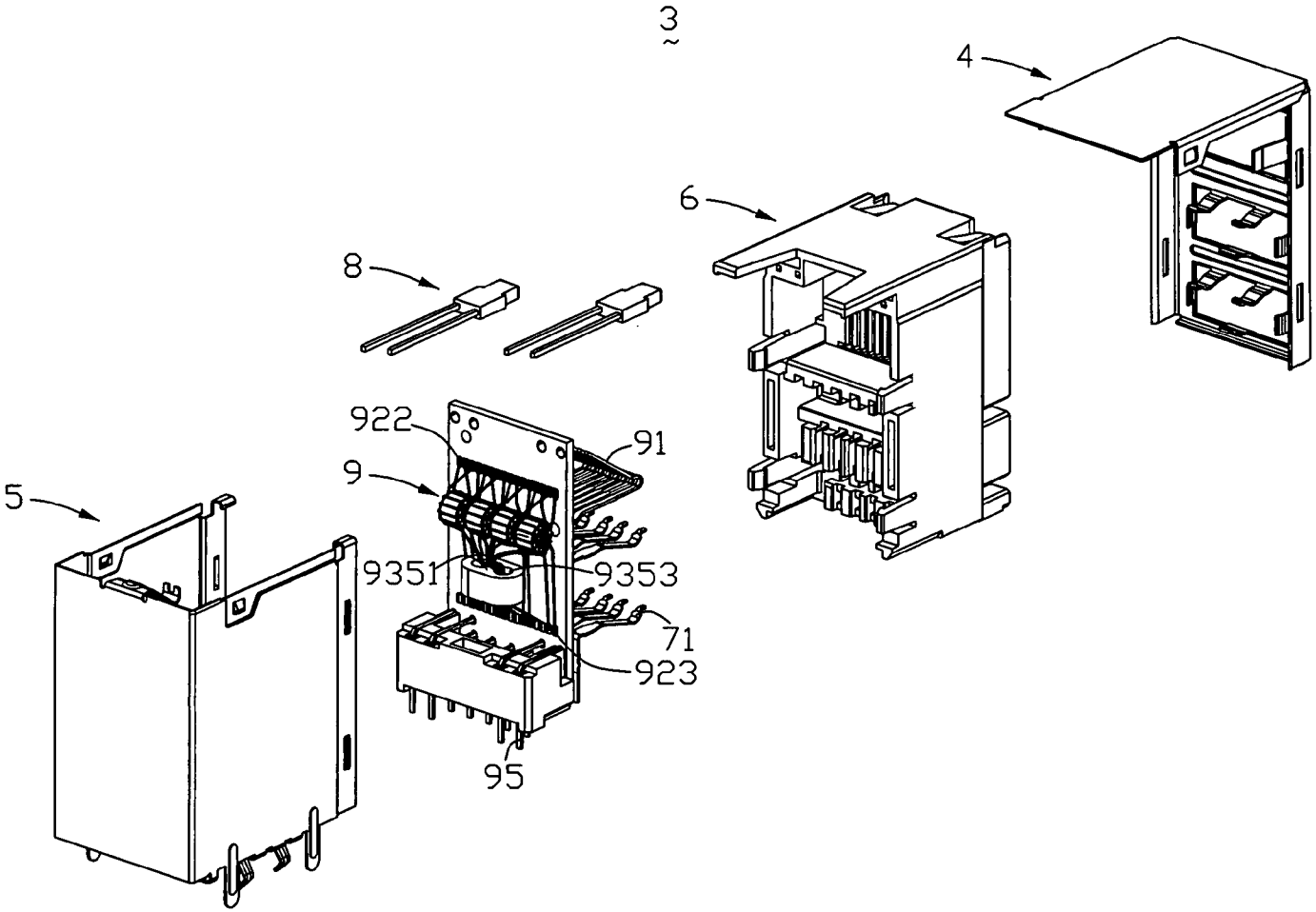
FIG. 6 is an exploded view of the modular jack as shown in FIG. 4, taken from another aspect.
Figure 7:
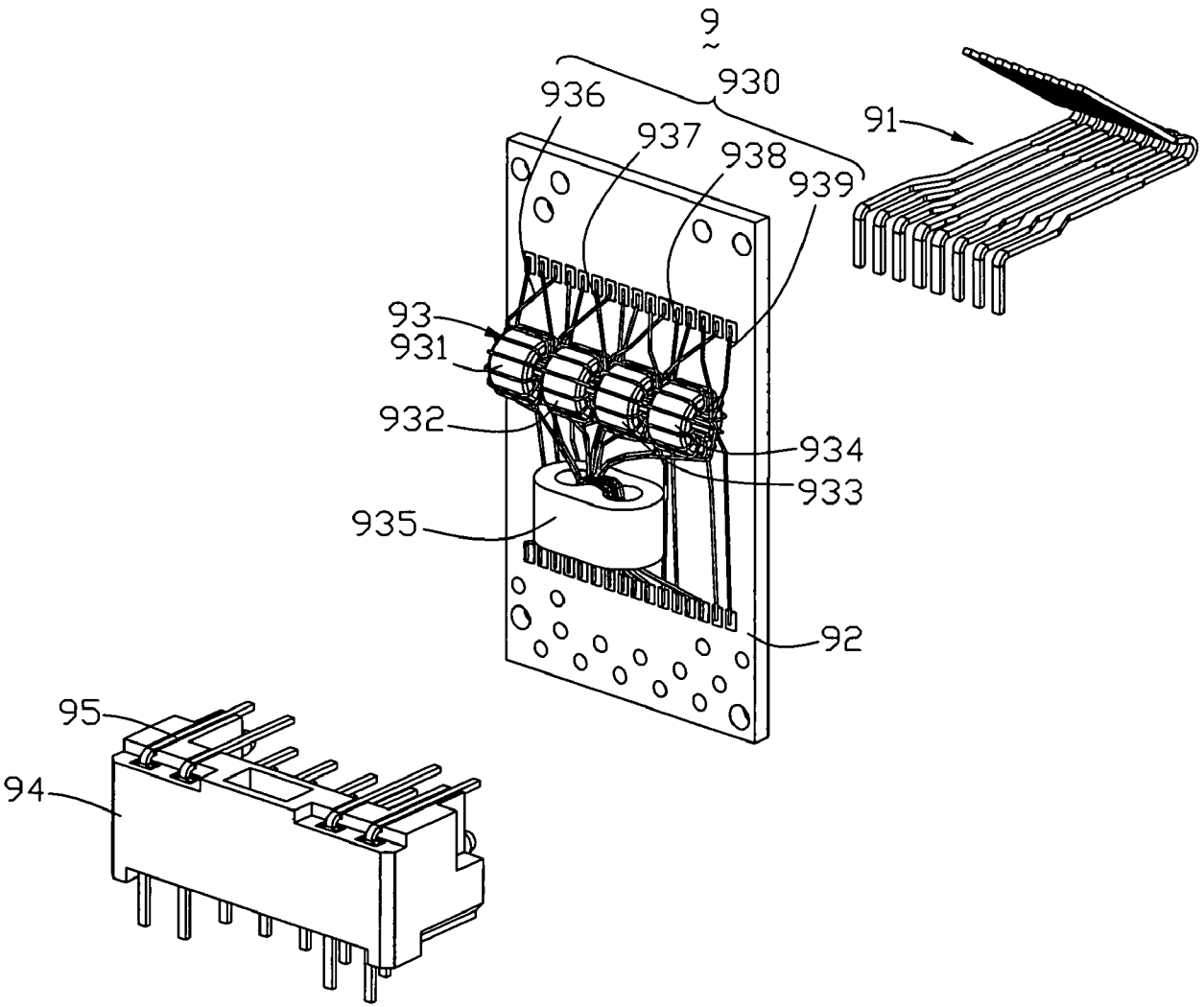
FIG. 7 is a partially exploded perspective view of a magnetic module, when a plurality of first, second terminals mounted on a printed circuit board.

Referring to FIGS. 5-7, and in conjunction with FIG. 2, the magnetic module 9 comprises a first core 931, a second core 932, a third core 933, a fourth core 934 and a magnetic core 935 interposed between the first set of terminals 91 and the second terminals 95. The magnetic core 935 defines two holes 9353 parallel extending therethrough and forming a center wall 9351 therebetween. The magnetic module 9 has a plurality of conductive wires 930 having first conductive wires 936 wound around the first core 931 and the magnetic core 935 for electrically connecting the first core 931 and the magnetic core 935 together, a plurality of second, third, and fourth conductive wires 937, 938 and 939 respectively wound around the second, the third and the fourth cores 932, 933 and 934. The first, second, third and fourth conductive wires 936, 937, 938 and 939 wind around the center wall 9351 and insert through said two holes 9353 in a same direction. The magnetic module 9 comprises a first, second, third and fourth ground coils 113*c*, 123*c*, 213*c*, 223*c* having opposite ended loads connected to the input port 101, and a first, second, third and fourth grounding wire 115*c*, 125*c*, 215*c*, 225*c* having opposite ends connected to the output port 102. Each ended load of the first, second, third and fourth ground coils 113*c*, 123*c*, 213*c*, 223*c* are respectively connected to the first, second, third and fourth conductive wires 936, 937, 938 and 939. Each opposite ended load of the first ground coil winds 113*c* around the magnetic core 935 for grounding. The opposite ended loads of the second, third and fourth ground coils 123*c*, 213*c*, 223*c* are directly connected to the first ground coil 113*c* for grounding. One end of the first, second, third and fourth grounding wires 115*c*, 125*c*, 215*c*, 225*c* are respectively connected to resistors and capacitors 96 disposed on the printed circuit board 92.

Figure 8:
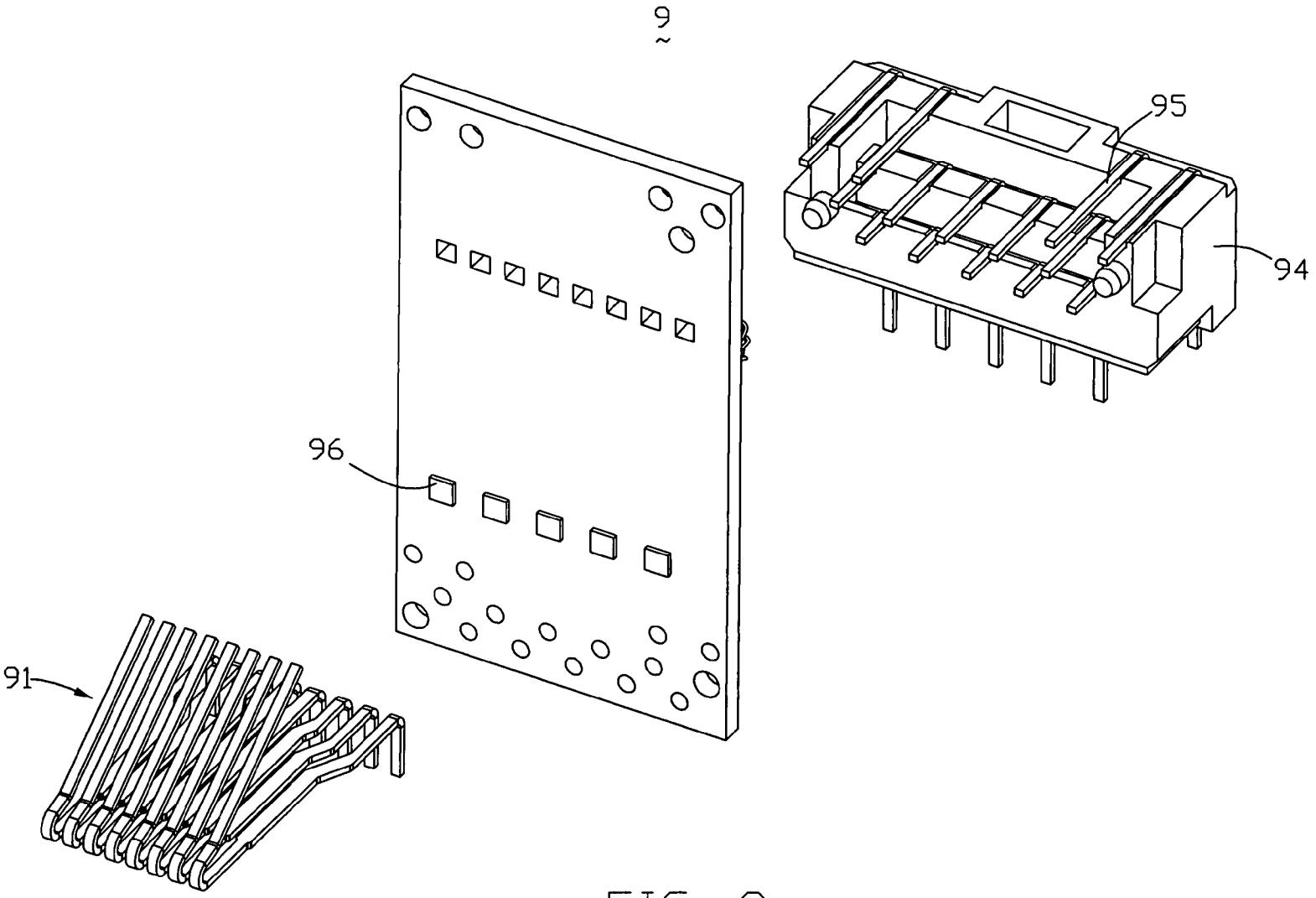
FIG. 8 is a view similar to FIG. 7, taken from another aspect.

Referring to FIGS. 7-8, the printed circuit board 92 comprises a first and second ends, a set of first conductive pads 922 arranged at the first end, a set of second conductive pads 923 arranged at the second end. The first, second, third and fourth conductive wires 936, 937, 938, 939 extend from the first conductive pad 922 and respectively wind through the first, second, third and fourth cores 931, 932, 933 and 934 to form as transformers, and wind the magnetic core 935 to function as a common mode filter, and then to the second conductive pad 923.

Referring to FIGS. 5-6, the modular jack 3 comprises a front shield 5 having a number of protrusions 51 disposed on an edge portion of the front shield 5 and a rear shield 4 defining corresponding recesses 41 thereon for mating with the protrusions 51 of the front shield 5.

Referring to FIGS. 5-6, in assembling, firstly, the first, second, third and fourth conductive wires 936, 937, 938 and 939 respectively wind around the first, the second, the third and the fourth cores 931, 932, 933 and 934, and wind around the magnetic core 935 at the same time. One ends of first conductive wires 930 are respectively soldered onto the row of the first conductive pads 922. The opposite ends of the first conductive wires 930 are connected onto the second conductive pads 923. Secondly, the first set of terminals 91, the second set of terminals 95 and the two groups of pins 71 are assembled to the printed circuit board 92. Thirdly, the LEDs 8 are received into the pipe slots 63. Fourthly, the magnetic module 9 is mounted to the rear portion of the housing 6. The first set of terminals 91 and the two groups of pins 71 are respectively received into the opening 61 and the receiving rooms 62. Finally, the front shield 5 and the rear shield 4 enclose the housing 6 and are locked with each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack, defining an input port and an output port with a plurality of transmission lines formed therebetween, comprising:

an insulative housing defining a receiving space;

a printed circuit board disposed within the receiving space;

a plurality of transformer cores and a common mode choke core disposed on the printed circuit boards;

a plurality of conductive wires respectively winding around the transformer cores to form primary coils and secondary coils of the transformers cores, each of the secondary coils having two opposite ends electrically connected to the output port, each of the primary coils having two opposite ends; and a plurality of conductive wires extending from said opposite ends of the primary coils of the transformer cores and winding around the common mode choke core to form a plurality of common mode coils, each common mode coil having one end connected to one end of the primary coil and an opposite end electrically connected to the input port;

wherein each of the transmission lines comprises the primary coil and the secondary coil of one of the transformers and two of said common mode coils connected to opposite ends of corresponding primary coil;

wherein the primary coil and the secondary coil in each transmission line share individual one of the transformer cores and the common mode coils in all transmission lines share said common mode choke core in common;

wherein said printed circuit board has first and second ends, a first array of conductive pads arranged at the first end, and a second array of conductive pads arranged at the second end, the transformer cores and the common mode choke core interposed between the first and second arrays of the conductive pads; and wherein said common mode choke core defines two holes parallel extending therethrough and forming a center wall therebetween, the common mode coils winding around the center wall in a same direction.

2. The modular jack as claimed in claim 1, further comprising a first set of terminals mounted to a front face of the printed circuit board and electrically connecting to the first array of conductive pads and a second set of terminals mounted to a rear face of the printed circuit board and electrically connecting to the second array of conductive pads.

3. The modular jack as claimed in claim 2, further comprising two groups of pins assembled to the insulative housing and paralleled to the first set of terminals.

4. The modular jack as claimed in claim 1, wherein said insulative housing defines a pair of receiving rooms profiled one above another for mating with USB plugs.

5. A communication port, defining an input port and an out put port with a plurality transmission lines formed therebetween, comprising:

a plurality of conductive wires respectively winding around transformer cores to form primary coils and secondary coils of the transformer cores, each of the secondary coils having two opposite ends electrically connected to the output port, each of the primary coils having two opposite ends; and a plurality of conductive wires extending from said opposite ends of the primary coils of the transformer cores and winding around common mode choke core to form a plurality of common mode coils, each common mode coil having one end connected to one end of the primary coil and an opposite end electrically connected to the input port;

wherein each of the transmission lines comprises the primary coil and the secondary coil of one of the transformers and two of said common mode coils connected to opposite ends of corresponding primary coil;

wherein the primary coil and the secondary coil in each transmission line share individual one of the transformer cores and the common mode coils in all transmission lines share said common mode choke core in common; wherein a printed circuit board has first and second ends, a first array of conductive pads arranged at the first end, and a second array of conductive pads arranged at the second end, the transformer cores and the common mode choke core interposed between the first and second arrays of the conductive pads; and wherein said common mode choke core defines two holes parallel extending therethrough and forming a center wall therebetween, the common mode coils winding around the center wall in a same direction.

6. The communication port as claimed in claim 5, wherein the common mode coils comprising a ground coil connecting one of the primary coils to the input port.

* * * * *